US008205672B2

(12) United States Patent
Misselbrook et al.

(10) Patent No.: US 8,205,672 B2
(45) Date of Patent: Jun. 26, 2012

(54) ACID TUNNELING BOTTOM HOLE ASSEMBLY AND METHOD UTILIZING REVERSIBLE KNUCKLE JOINTS

(75) Inventors: John Gordon Misselbrook, Calgary (CA); Alexander Raphael Crabtree, Conroe, TX (US); Lance N. Portman, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 48 days.

(21) Appl. No.: 12/259,930

(22) Filed: Oct. 28, 2008

(65) Prior Publication Data

US 2009/0114449 A1 May 7, 2009

Related U.S. Application Data

(63) Continuation-in-part of application No. 11/799,911, filed on May 3, 2007, now abandoned.

(51) Int. Cl.
*E21B 43/00* (2006.01)
*E21B 7/18* (2006.01)
*E21B 43/114* (2006.01)

(52) U.S. Cl. ..... 166/222; 175/424; 175/64

(58) Field of Classification Search ..... 175/61, 175/321, 424, 62, 64, 65, 80; 166/222, 223
See application file for complete search history.

(56) References Cited

U.S. PATENT DOCUMENTS

| | | | | |
|---|---|---|---|---|
| 4,693,327 | A * | 9/1987 | Dickinson et al. | 175/61 |
| 4,763,734 | A * | 8/1988 | Dickinson et al. | 175/61 |
| 6,527,067 | B1 | 3/2003 | Ravensbergen et al. | 175/381 |
| 6,920,945 | B1 | 7/2005 | Belew et al. | |
| 2001/0045282 | A1 | 11/2001 | Robinson | |
| 2002/0023781 | A1 | 2/2002 | Peters | |
| 2003/0234106 | A1 * | 12/2003 | Surjaatmadja | 166/308 |
| 2006/0201670 | A1 * | 9/2006 | Stewart | 166/241.6 |
| 2007/0151766 | A1 | 7/2007 | Butler et al. | |

OTHER PUBLICATIONS

Non Final Office Action Mailed Oct. 7, 2008, Notices of References Cited, Re Parent U.S. Appl. No. 11/799,911.

* cited by examiner

*Primary Examiner* — Cathleen Hutchins
(74) *Attorney, Agent, or Firm* — Parsons Behle & Latimer

(57) ABSTRACT

A bottom hole assembly connected to coiled tubing to create an acid tunnel in a wellbore formation. High pressure acid is pumped down the coiled tubing and out a nozzle located at the end of the bottom hole assembly. The bottom hole assembly includes a first reversible knuckle joint and a second reversible knuckle joint to properly position the nozzle against the wellbore and to allow the assembly to adjust its angle as it initiates and moves through the lateral tunnel. The two reversible knuckle joints increases the radius of curvature of the bottom hole assembly while providing a sufficient attack angle for the nozzle against the wellbore. The two knuckle joints may be adjusted in response to loads applied on the assembly as the assembly moves through the lateral tunnel.

27 Claims, 6 Drawing Sheets

ACID TUNNELING BOTTOM HOLE ASSEMBLY AND METHOD UTILIZING REVERSIBLE KNUCKLE JOINTS

PRIORITY

This application is a continuation-in-part application claiming priority to U.S. Non-Provisional application Ser. No. 11/799,911 entitled "IMPROVED ACID TUNNELING BOTTOM HOLE ASSEMBLY" by John G. Misselbrook and Alexander R. Crabtree, filed May 3, 2007, now abandoned owned by the Assignee of the present invention, BJ Services Company of Houston, Tex., which is hereby incorporated by reference in its entirety.

BACKGROUND OF THE INVENTION

1. Field of the Invention

The present invention generally relates to a coiled tubing bottom hole assembly used to create an acid tunnel in a wellbore formation such that the tunnel is substantially transverse to the wellbore. In particular, the present invention relates to a coiled tubing bottom hole assembly utilizing reversible knuckle joints to create a tunnel substantially transverse to the wellbore.

2. Description of the Related Art

It has become common to stimulate a wellbore in an effort to increase the production of hydrocarbons. One method to stimulate an openhole wellbore is to create an acid tunnel that is substantially transverse to the wellbore. Acid tunneling, also referred to as chemically-enhanced drilling, is a process that uses a nozzle attached to a bottom hole assembly that is run into the wellbore with coiled tubing. Once the nozzle is located at the desired location within the wellbore, acid is pumped down the coiled tubing at a high pressure. The high pressure acid exits the nozzle and dissolves the formation adjacent to the nozzle creating a tunnel. The tunnel may be created at a specified location of the wellbore to extend beyond a damaged or non-producing portion of the well.

The bottom hole assembly preferably includes a knuckle joint used to angle the nozzle towards the side of the wellbore. The nozzle is typically located on the end of a wand connected to the knuckle joint. The diameter of the wellbore as well as the geometric configuration of the wand, nozzle, and bottom hole assembly dictate the angle at which the knuckle joint can be bent within the wellbore. The rigidity of the bottom hole assembly causes the bottom hole assembly to have a fixed radius of curvature. The radius of curvature is dictated by the length of the wand, the angle that the knuckle joint bends, and the length of the assembly from the knuckle joint to the coiled tubing connection. These dimensions define a fixed radius through which the bottom hole assembly may travel.

It is generally desired to create an acid tunnel that is substantially transverse to the wellbore so that the tunnel extends beyond a damaged area of the wellbore. It is also important that the tunnel be substantially traverse because it may be desirable to create multiple tunnels within the wellbore. It is important that the attack angle of the nozzle be sufficient to create a tunnel that is substantially transverse to the wellbore. The knuckle of the bottom hole assembly needs to position the nozzle against the wellbore to ensure that the flow of acid out of the nozzle begins to form a tunnel. If the attack angle is too shallow, the high pressure acid may simply widen the bore of the wellbore rather than creating a tunnel transverse to the wellbore. To encourage the creation of a tunnel, the knuckle joint is often configured to have a maximum bend angle of approximately fifteen degrees away from the center of the bottom hole assembly. A fifteen degree bend angle typically allows knuckle to bend causing the nozzle located on the end of the wand to come into contact with the wellbore. Typically, the knuckle will not be bent to its maximum angle until after the tunnel has begun to form. The angle required for the knuckle to contact the wellbore can be decreased by increasing the length of the wand. However, increasing the length of the wand also increases the chance that the wand may become cam locked as it traverse the wellbore and the tunnel entrance.

The coiled tubing is used to push the bottom hole assembly and increase the length of the acid tunnel. The bottom hole assembly is rigid and as discussed above, the geometry of the bottom hole assembly (i.e. the bend angle of the knuckle joint, the length of the wand, and the length from the coiled tubing to the knuckle joint) defines the radius of curvature or "build rate" of the bottom hole assembly. The build rate of the bottom hole assembly determines the "build angle" of the tunnel (i.e. how quickly the tunnel turns so that it is transverse to wellbore). Often it may be desirable to create multiple tunnels in a single wellbore. Thus, it is important to have a build rate in the tunnel that is as high as practically possible, but not so high that it exceeds the yield strength of the coiled tubing that is connected to the tunneling bottom hole assembly. For example, in a 6 inch diameter wellbore, the current bottom hole assembly for acid tunneling typically has a theoretical build rate of 300 degrees per 100 feet of tunnel. This theoretical build rate exceeds the yield radius of curvature of typical coiled tubing. It would thus be beneficial to provide a bottom hole assembly that has a lower build rate, but that also may position the nozzle against the wellbore to ensure a tunnel transverse to the wellbore is created, but with a higher initial starting angle.

Current bottom hole assemblies have been use to create acid tunnels of up to fifty feet or more in length without damaging the coiled tubing. As discussed above, the theoretical build rate of the current bottom hole assembly exceeds the elastic limit of coiled tubing. In theory, if a fifty foot tunnel is created with the maximum build rate of the current acid tunneling bottom hole assembly, then the coiled tubing would exceed yield and the force required to push the tunneling bottom hole assembly along the tunnel would exceed the buckling strength of the unsupported coiled tubing in the borehole. However, there have been instances where a fifty foot tunnel has been created without appreciable damage to the coiled tubing. One explanation for this occurrence is that the bottom hole assembly may have titled or twisted out of its original plane while creating the tunnel while at the same time creating an elongated slot that allows the bottom hole assembly to slide downwards rather than turning a corner. The bottom hole assembly most likely twisted out of plane due to the forces exerted upon the bottom hole assembly as the build rate approaches the coiled tubing's yield radius of curvature. These forces likely cause the bottom hole assembly to twist off its plane affecting the direction and location of the acid tunnel.

The twisting or tilting of the bottom hole assembly out of its original plane may cause the acid tunnel to be formed in an area other than its intended location. For example, the tunnel may not extend through the very damaged or non-producing zone as originally intended. The rotation of the bottom hole assembly may also cause the tunnel to travel substantially parallel with the wellbore rather than substantially transverse limiting the number of tunnels that may be created as well as limiting the beneficial affects from the acid tunnel.

In light of the foregoing, it would be desirable to provide a bottom hole assembly that has a reduced build rate, but still create a tunnel that is substantially transverse to the wellbore. It would further be desirable to provide a bottom hole assembly with two knuckle joints to increase the overall radius of curvature of the bottom hole assembly above the yield radius of curvature of the coiled tubing. It would be desirable to orient the two knuckle joints such that the joints would bend in the same plane. It may also be desirable to provide a bottom hole assembly with an extendable or telescopic wand to aid in the formation of an acid tunnel. It would also be desirable to provide a nozzle adapted to form an acid tunnel that encourages the bottom hole assembly to remain in its original plane as the acid tunnel is created. Moreover, it would be desirable to have the ability to adjust the angles of the knuckle joints during lateral initiation and navigation through the lateral tunnel.

The present invention is directed to overcoming, or at least reducing the effects of, one or more of the issues set forth above.

SUMMARY OF THE INVENTION

The present invention provides assemblies and methods for lateral tunneling within a wellbore whereby the assembly is adapted to adjust its angle during lateral turneling. In an exemplary embodiment of the present invention, an apparatus comprises a tool assembly having an internal fluid passage, coiled tubing connected to the tool assembly, a first and second reversible knuckle joint, a wand having, wherein the first and second reversible knuckle joints are adapted to adjust angles during tunneling. The knuckle joints are adapted to adjust in response to geometrical constraints within the lateral window and the lateral itself. The knuckle joints are further adapted to adjust in response to the set down weight on the tool, when seeing full differential pressure. Moreover, the knuckle joints have the ability to be straightened by external mechanical forces on the bottom hole assembly.

An exemplary method of the present invention provides a method of creating a lateral tunnel within a wellbore, the method comprising the steps of: connecting a bottom hole assembly to coiled tubing, the bottom hole assembly comprises an upper reversible knuckle joint, a lower reversible knuckle joint, and a nozzle located below the lower reversible knuckle joint; positioning the bottom hole assembly at a desired location within the wellbore; actuating at least one of the upper or lower reversible knuckle joints, wherein the nozzle moves towards the wellbore; initiating a lateral tunnel substantially transverse to the wellbore, thereby creating a lateral window; adjusting an angle of at least one of the upper or lower reversible knuckle joints such that the bottom hole assembly is allowed to move into the lateral window; and creating the lateral tunnel.

Figure 1:
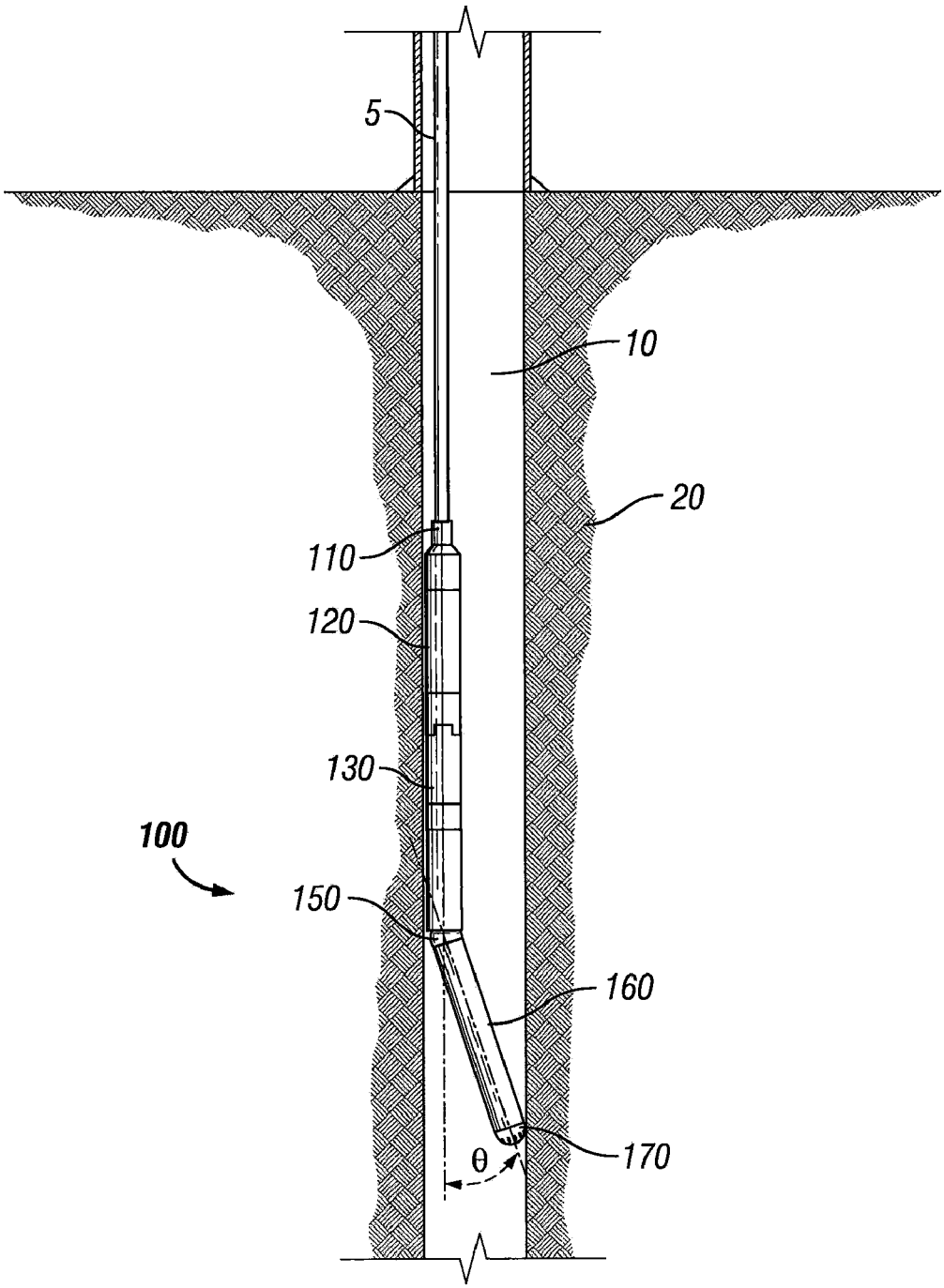
FIG. 1 (Prior Art)
FIG. 1 shows a current bottom hole assembly used to create an acid tunnel off a wellbore, the assembly having a single pressure elbow that moves a nozzle into contact with the wellbore.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in a bottom hole assembly having a radius of curvature that is greater than the yield radius of curvature of coiled tubing and that may be used to produce an acid tunnel transverse to a wellbore. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows the configuration of a typical bottom hole assembly 100 that is used to create an acid tunnel 30 (shown in FIG. 2) within the formation 20 such that the tunnel 30 is substantially transverse to the wellbore 10. The bottom hole assembly 100 is connected to coiled tubing 5 by a coiled tubing connector 110. At the lower end of the bottom hole assembly 100 is a pressure elbow 150 that is actuated to move a wand 160 and nozzle 170 towards the wellbore 10. The bottom hole assembly 100 may include various components such as a check valve 120 and hydraulic disconnect 130 as would be appreciated by one of ordinary skill in the art.

Figure 2:
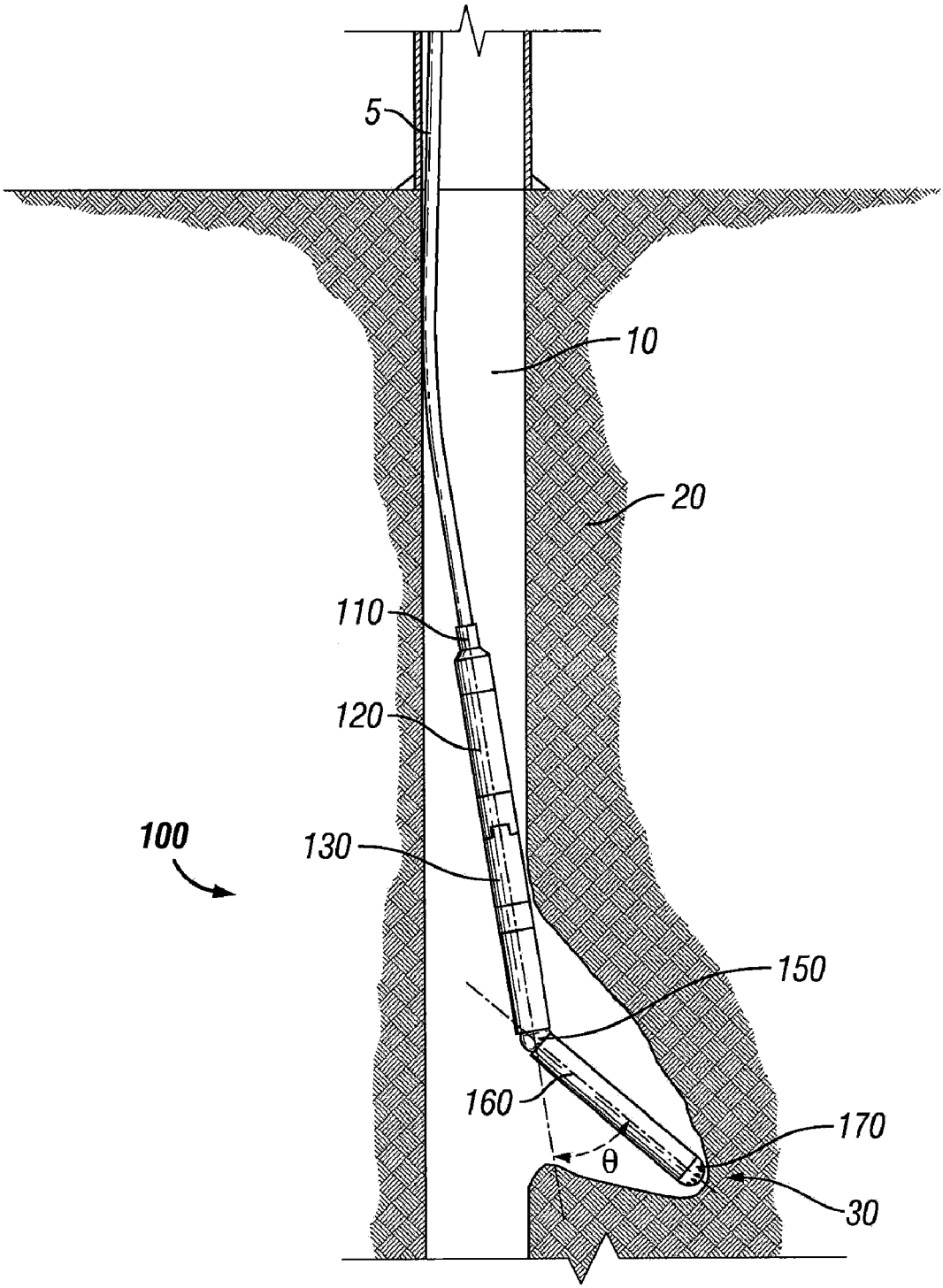
FIG. 2 (Prior Art)
FIG. 2 shows the bottom hole assembly of FIG. 1 starting to create a tunnel in the wellbore.

Acid is pumped at a high pressure down the coiled tubing and through the bottom hole assembly 100 until the acid exits the nozzle 170. The back pressure from the nozzle causes the pressure elbow 150 to be actuated positioning the nozzle 170 against the wellbore. At this position, the acid exiting the nozzle begins to dissolve the formation 20 creating a tunnel 30 as shown in FIG. 2. The coil tubing is then lowered into the wellbore 10 advancing the formation of the tunnel 30 through the formation 20. As the tunnel 30 is created the bottom hole assembly 100 advances into the tunnel 30. However, the geometry of the bottom hole assembly 100 dictates the radius through which the bottom hole assembly 100 may travel. Specifically, the distance from the nozzle 170 to the pressure elbow 150, the angle of the pressure elbow 150, and the distance from the pressure elbow 150 to the coiled tubing connector 110 determines the radius through which the bottom hole assembly 100 may travel.

With the configuration shown in FIG. 1, the pressure elbow 150 generally is actuated to an initial kickover angle θ from the centerline of the bottom hole assembly 100 to ensure that the nozzle 170 comes into contact with the wellbore 10. This is done to ensure that the acid begins to create a tunnel into the side of the wellbore 10. The geometry of the bottom hole assembly 100 as well as the wellbore 10 dictates the initial kickover angle θ required to have the nozzle 170 contact the side of the wellbore 10 as illustrated by the following formula whereas l is the length of the wand 160, D is the diameter of the wellbore 10, and d is diameter of the bottom hole assembly 100.

$$l \sin \theta > D - d/2$$

The above formula illustrates that in order to have the nozzle 170 touch the side of the wellbore 10 the length l of the wand multiplied the sine of the angle θ must be greater than the diameter D of the wellbore minus ½ of the diameter d of the bottom hole assembly. Thus, increasing the wand length decreases the angle θ necessary to touch the wellbore. As discussed above, increasing the length of the wand 160 increases the chance that the bottom hole assembly 100 may become cam locked within the tunnel 30. However, increasing the initial kickover angle θ also decreases the radius of curvature such that the radius of curvature of the bottom hole assembly 100 may be smaller than the yield radius of the coiled tubing 5.

Once the tunnel is begun, the pressure elbow 150 is bent to its maximum kickover angle θ to increase the build angle of the tunnel as shown in FIG. 2. Typically the maximum kickover angle θ is less than fifteen degrees. This current configuration of the bottom hole assembly creates a radius of curvature of the bottom hole assembly 100 that is smaller than the yield radius of curvature of coiled tubing which may cause unacceptable forces on the coiled tubing as it creates a tunnel 30. The length of the wand 160 may be increased in an effort to decrease the kickover angle θ required to touch the wellbore with the nozzle 170. However, increasing the length of the wand 160 also increases the chance that the bottom hole assembly 100 will become cam locked within the tunnel 30. For at least these reasons, it may be beneficial to provide a new configuration that may overcome these potential issues.

Figure 3:
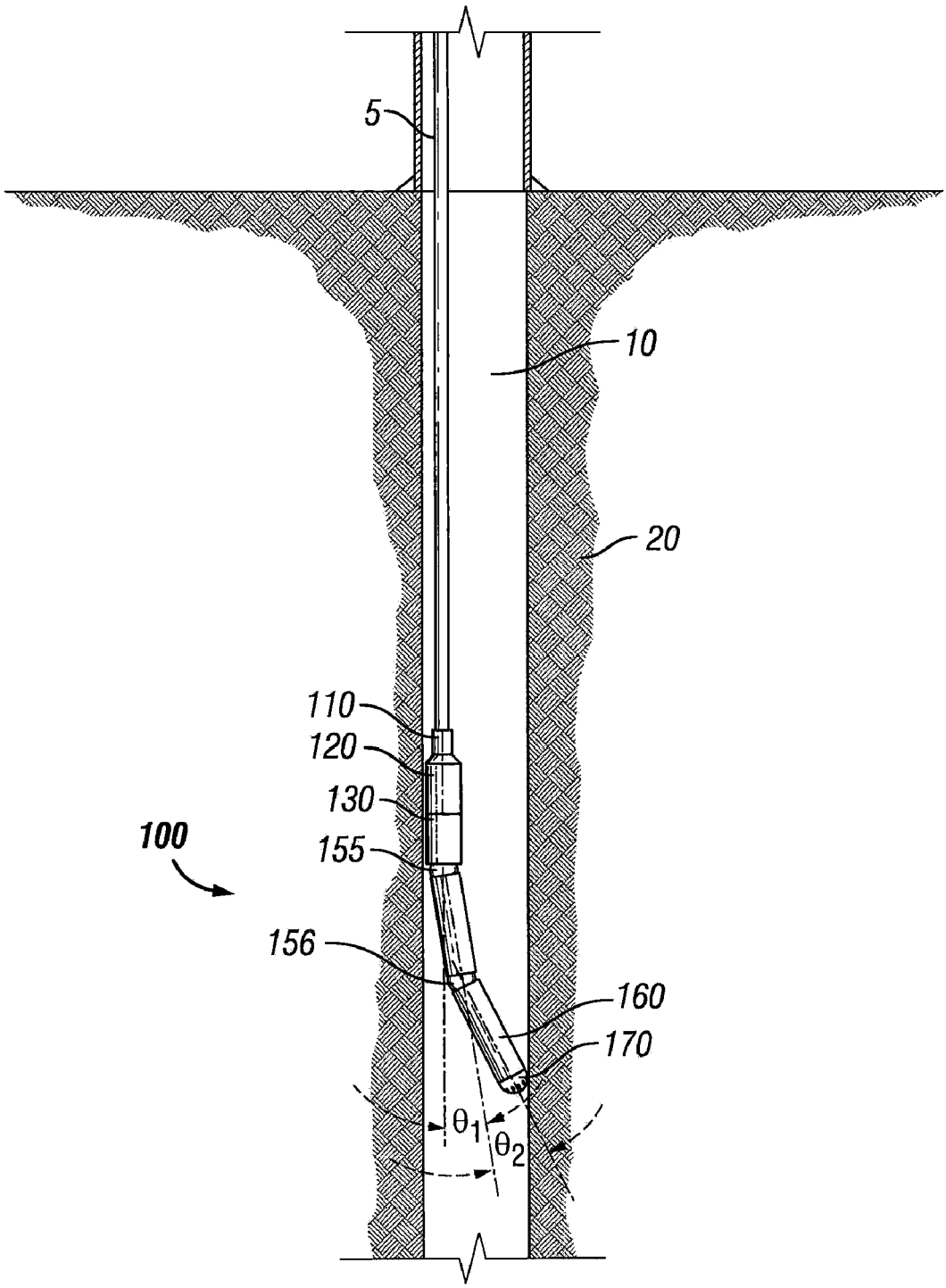
FIG. 3 shows one embodiment of a bottom hole assembly that may be used to create an acid tunnel off a wellbore, the bottom hole assembly including two knuckle joints to increase the radius of curvature of the bottom hole assembly while providing that the tunnel is substantially transverse to the wellbore.

FIG. 3 shows the configuration of one embodiment of a bottom hole assembly 100 that includes a first knuckle joint 155 and a second knuckle joint 156 used to create an acid tunnel 30 within the formation 20 so that the tunnel 30 is substantially transverse to the wellbore 10. The two knuckle joints 155, 156 are actuated to touch the nozzle 170 to the side of the wellbore 10 and permits the use of a shorter wand 160 than the prior configuration. The two knuckle joints 155, 156 increases the radius of curvature of the bottom hole assembly 100 while increasing the attack angle of the nozzle 170 to the wellbore 10.

Figure 4:
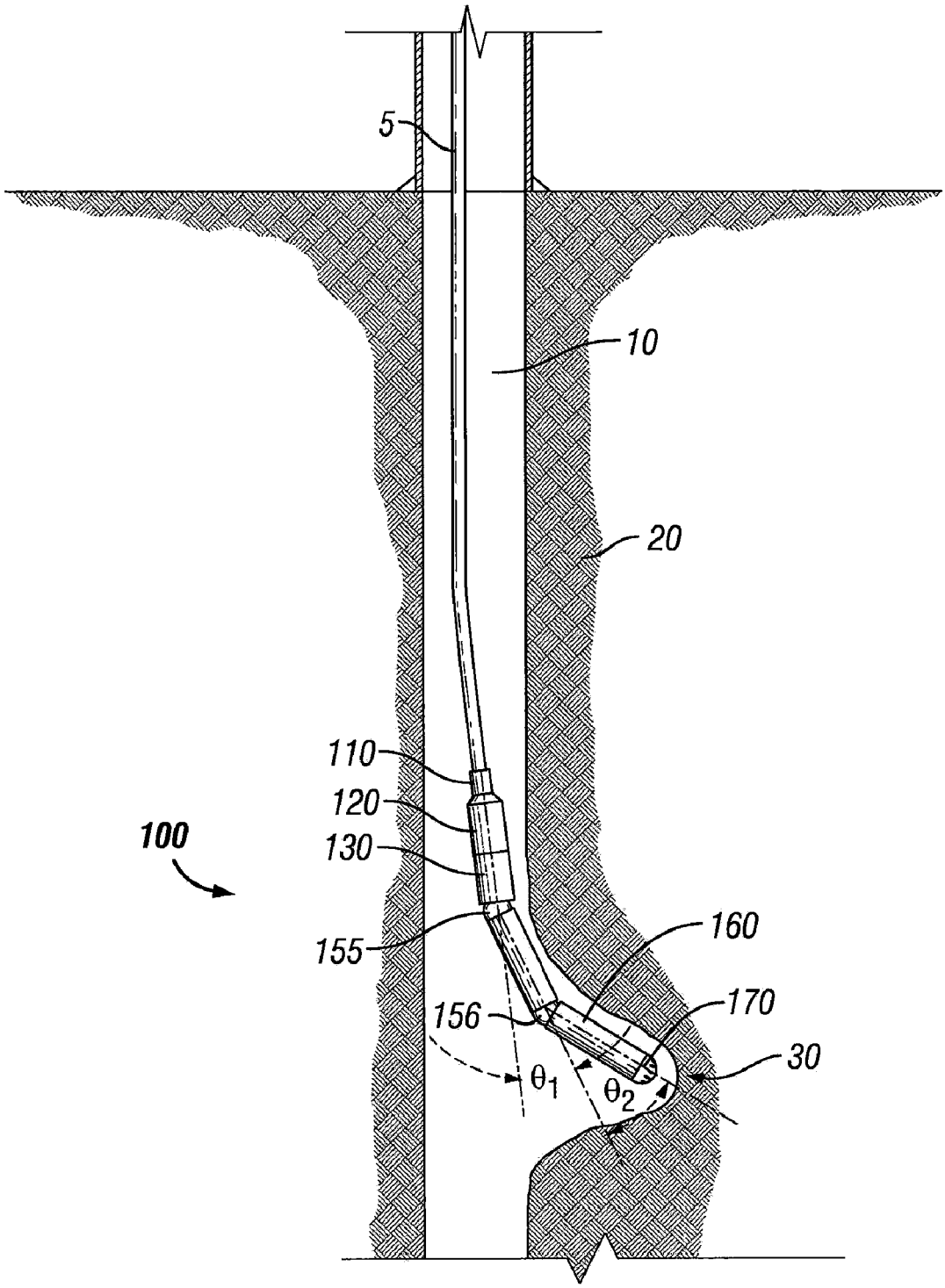
FIG. 4 shows the bottom hole assembly of FIG. 3 starting to create a tunnel that is substantially transverse to the wellbore.

Acid may be pumped at a high pressure down the coiled tubing and through the bottom hole assembly 100 until the acid exits the nozzle 170. With the nozzle 170 positioned against the wellbore 10, the acid exiting the nozzle 170 begins to dissolve the formation 20 and create a tunnel 30 as shown in FIG. 4. The coiled tubing may be lowered into the wellbore 10 advancing the formation of the tunnel 30 through the formation 20. As the tunnel 30 is created the bottom hole assembly 100 advances into the tunnel 30. The use of two knuckle joints 155, 156 provides that the tunnel 30 will be substantially transverse to the wellbore by increasing the starting angle of the tunnel, but without increasing the build angle of the tunnel.

The use of two knuckles 155, 156 increases the lateral displacement of the nozzle 170 with a smaller initial kickover angle $\theta_1$, $\theta_2$ for each knuckle. Assuming that the length l of the wand 160 is equal to the length between the first knuckle 155 and the second knuckle 156 and that the initial kickover angle $\theta_1$ for the first knuckle 155 is equal to the kickover angle $\theta_2$ for the second knuckle 156, the following equation may be used to determine the minimum kickover angle θ required for the nozzle 170 to touch the wall of the wellbore 10.

$$l(\sin \theta + \sin 2\theta) > D - d/2$$

The above formula illustrates that a smaller initial kickover angle is required to touch the nozzle 170 to the wall of the wellbore 10 when the bottom hole assembly 100 includes two knuckle joints 155, 156. The use of two knuckle joints provides that a smaller maximum kickover angle may be used for each knuckle joint without sacrificing a quick build angle for the tunnel. The use of two knuckle joints also permits a smaller maximum kickover angle may be used to create a tunnel substantially transverse to the wellbore. The use of smaller maximum kickover angles may be used to increase the radius of curvature of the bottom hole assembly above the yield radius of curvature of coiled tubing while still providing a sufficient attack angle and build angle.

Figure 5:
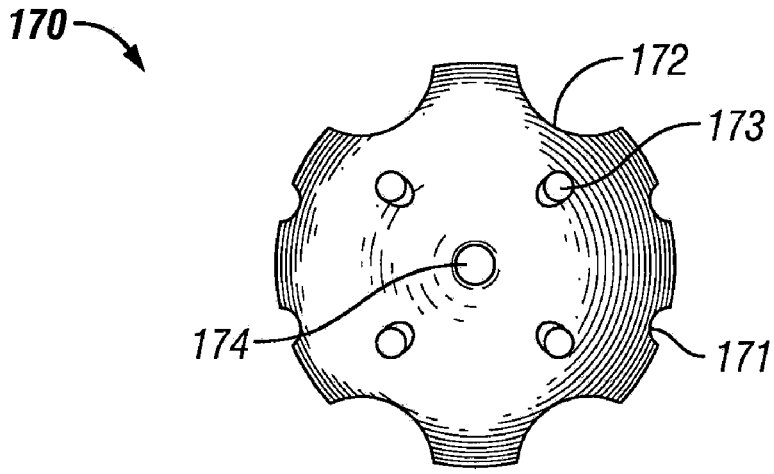
FIG. 5 is the end view of one embodiment of a nozzle having fluid ports in a symmetrical pattern with flow channels in an asymmetrical pattern adapted to form an elliptical hole in a wellbore formation.
Figure 6:
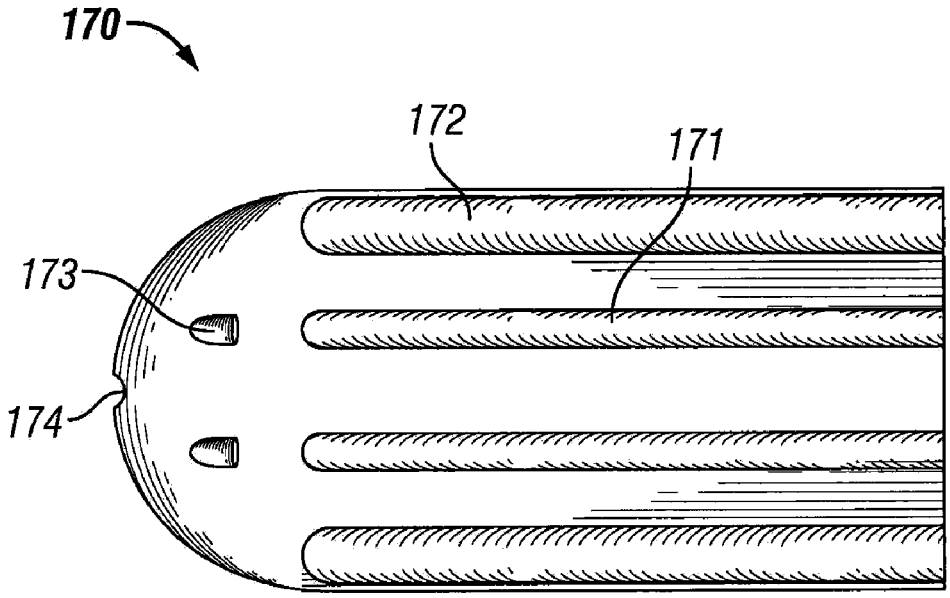
FIG. 6 is the side view of the nozzle having flow channels in an asymmetrical pattern shown in FIG. 5.

FIGS. 5 and 6 show one embodiment of a nozzle 170 that has been adapted to promote the formation of an elliptical hole in a wellbore formation. The nozzle 170 includes fluid ports 173 that may be angled, as shown in FIG. 5, to promote the creation of an elliptical shaped hole. The nozzle 170 also includes a central fluid port 174. The nozzle 170 includes a plurality of grooves or flow channels 171, 172 on the exterior of the nozzle 170 that provide a pathway for the acid to flow past the nozzle after it has been jetted against the wellbore formation. The size and placement of the grooves may be configured in an asymmetrical pattern to promote the formation of an elliptical hole by the nozzle 170. For example, one set of grooves 172 may have a larger passage area that another set of grooves 171 allowing more acid to pass along the exterior of the nozzle 170. Portions of the wellbore may be dissolved faster than the rest of the wellbore due to a longer duration of exposure to the acid. The differences in acid flow along the nozzle may be used to promote the formation of an elliptical hole in the wellbore. As would be appreciated by one of ordinary skill the art having the benefit of this disclosure, the configuration and sizes of the exterior flow paths may be varied within the spirit of this invention.

Figure 7:
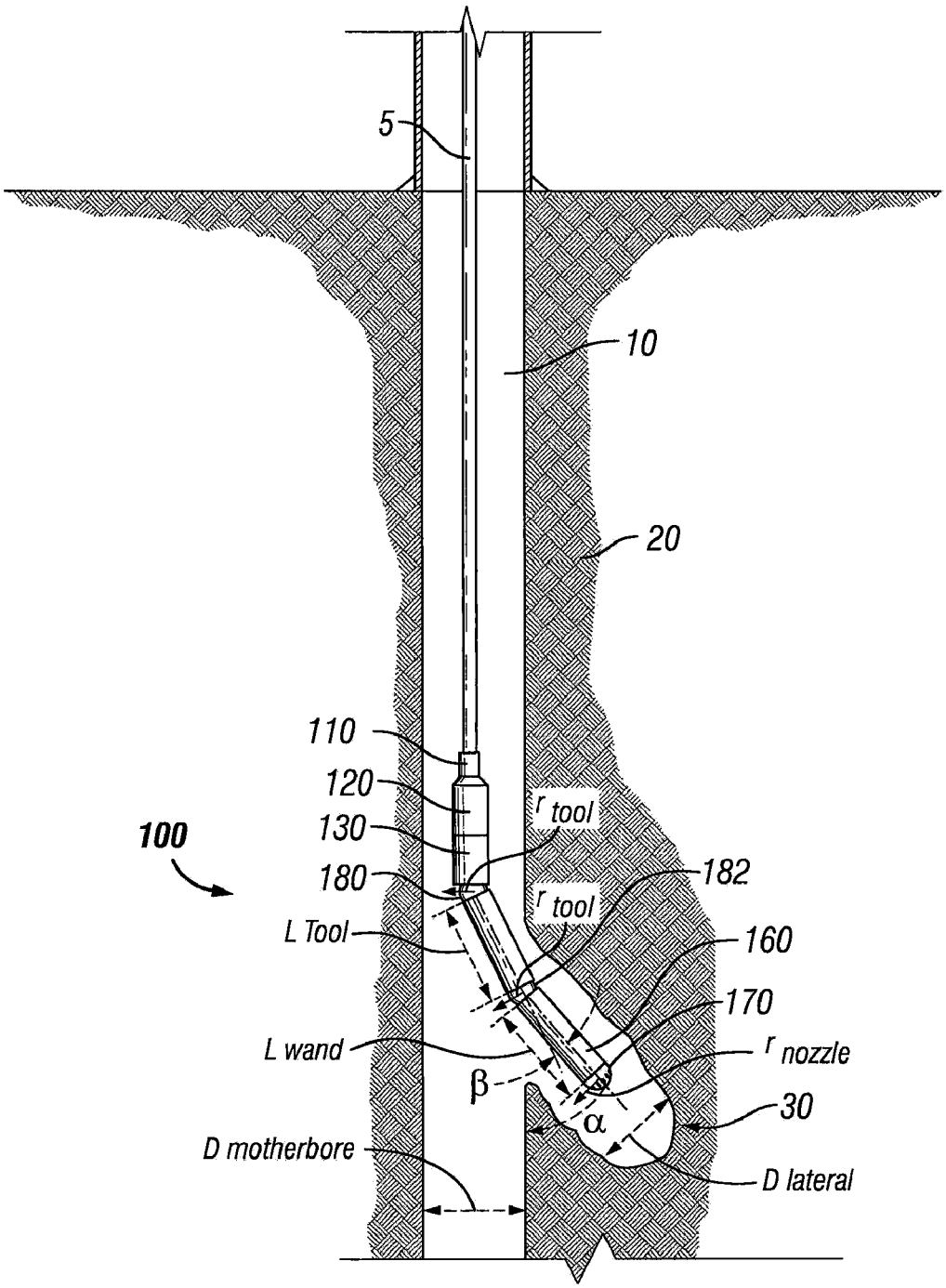
FIG. 7 shows the bottom hole assembly utilizing reversible knuckle joints according to an alternative exemplary embodiment of the present invention.

FIG. 7 illustrates an alternative embodiment of the present invention utilizing double reversible knuckle joints. Here, bottom hole assembly 100 is constructed as previously described except that reversible knuckle joints 180,182 are used. Unlike knuckle joints 155,156, once knuckle joints 180,182 are activated, they remain flexible rather than rigid. Reversible knuckle joints 180,182 may be pressure or flow activated as known in the art. An example of a reversible knuckle joint which may be utilized in the present invention include those disclosed in U.S. Pat. No. 6,527,067, issued on Mar. 4, 2003 to John E. Ravensbergen et al, entitled "LATERAL ENTRY GUIDANCE SYSTEM (LEGS)," owned by the Assignee of the present invention, BJ Services Company of Houston, Tex., which is hereby incorporated by reference in its entirety. Please note, however, those ordinarily skilled in the art having the benefit of this disclosure realize other comparable knuckle joints may be utilized with the present invention.

Once activated, knuckle joints 180,182 bend to an angle determined by the space available down hole, or until a preset limit is reached. As the new lateral is initiated, the available space for the tool changes. For the tool to navigate through the newly created lateral window, knuckle joints 180,182 must adjust their angles to exit through the window and into the new lateral tunnel 30. Knuckle joints 180,182 must adjust their angles in response to loads applied to the tool by the walls of wellbore 10 and, therefore, knuckles 180,182 must be reversible (i.e., down hole loads can overcome the activating drive device (e.g. pressure)). Those ordinarily skilled in the art having the benefit of this disclosure realized there are a variety of reversible knuckle joints which may be utilized with this exemplary embodiment of the present invention. Moreover, although described herein as having two reversible knuckle joints, those ordinarily skilled in the art having the benefit of this disclosure realize more knuckle joints may be utilized.

For the downhole assembly 100 to navigate into a newly constructed lateral 30, the initial angle of attack of the assembly 100 needs to be controlled so as to limit the dogleg entry angle ($\alpha$) into the new lateral 30. Too high an attack angle will prevent the assembly 100 from navigating through the window to the new lateral 30. To ensure this scenario does not occur, a limit will sometimes be required on the angle that the lower knuckle joint 182 can assume. This limit is calculated using geometry, and is based on ensuring that the maximum straight length of assembly 100 above the nozzles 170 can turn the corner into the new lateral 30. This maximum dogleg angle ($\alpha_{max}$) is derived using the following equation:

$$L_{tool} = \left[ \frac{D_{motherbore} - r_{tool}}{\sin\theta} + \frac{D_{lateral} - r_{tool}}{\sin(\alpha_{max} - \theta)} - \frac{r_{tool} \cdot \sin\alpha_{max}}{\sin\theta \cdot \sin(\alpha_{max} - \theta)} \right]_{Minimum for\ 0<\theta<\alpha_{max}}$$

The maximum dogleg angle ($\alpha_{max}$) is a function of the hole and tool diameters, and the length of straight tool ($L_{tool}$) that must navigate through the junction.

The actual angle of attack (i.e., dogleg entry angle) ($\alpha$) is determined by the tool length ($L_{tool}$), the wand length ($L_{wand}$) and the maximum lower knuckle joint angle ($\beta_{max}$). The actual angle of attack ($\alpha$) is derived using the following equation:

$$L_{tool} \cdot \sin(\alpha - \beta_{max}) + L_{wand} \cdot \sin\alpha + r_{nozzle} \cdot \cos\alpha = D_{motherbore} - r_{tool}$$

With the condition that $\beta_{max} \leqq \alpha$.

For the tool to navigate through the junction, $\alpha$ must be less than or equal to $\alpha_{max}$, so defining $\beta_{max}$. This embodiment of the tool requires that the lower knuckle joint activate preferentially to the upper knuckle joint. Those ordinarily skilled in the art having the benefit of this disclosure realize that, if more than two reversible knuckle joints are utilized, the beforementioned math may be tailored to fit such embodiments.

It is sometimes beneficial to enlarge the mother bore and lateral tunnel diameters at the lateral initiation point. Accordingly, in yet another exemplary embodiment, a fluid, such as acid, for example, may be pumped through the assembly 100 in order to enlarge the wellbore 10 and/or lateral tunnel 30, in order to improve navigation through tunnel 30. The benefit of enlarging the wellbore and lateral diameters is to permit a longer tool length to navigate the junction, and/or provide for a higher kick-out angle for the lateral 30. To achieve this, assembly 100 is positioned at the intended lateral tunnel initiation point and acid is pumped through assembly 100. In one exemplary embodiment, assembly 100 is stationary in the kicked out position, and acid is pumped for several minutes or longer, and may involve the pumping of a higher strength acid. However, those ordinarily skilled in the art having the benefit of this disclosure realize a variety of fluids may be utilized for this purpose and the fluid may be pumped at different points in the lateral tunneling process.

An exemplary embodiment of the present invention provides an apparatus for lateral tunneling within a wellbore, the apparatus comprising: a tool assembly having an upper end and a lower end, the tool assembly having an internal fluid passage; coiled tubing connected to the upper end of the tool assembly, the coiled tubing is in fluid communication with the internal passage of the tool assembly; a first reversible knuckle joint connected to the tool assembly, the first reversible knuckle joint having a central bore in fluid communication with internal passage of the tool assembly; a second reversible knuckle joint, the second reversible knuckle joint having a central bore in communication with the central bore of the first reversible knuckle joint, the second reversible knuckle joint being connected below the first reversible knuckle joint; a wand having a first end, a second end, and a central bore, the first end of the wand being connected below the second reversible knuckle joint, wherein the central bore of the wand is in fluid communication with the central bore of the second reversible knuckle joint; and a nozzle connected to the second end of the wand, wherein the nozzle is in fluid communication with the coiled tubing, wherein the first and second reversible knuckle joints are adapted to adjust angles during tunneling.

In yet a further exemplary embodiment, the wand is telescopic. In another embodiment, the first reversible knuckle joint and the second reversible knuckle joint are adapted to bend in the same plane. Also, in another exemplary embodiment, the radius of curvature of the apparatus is more than the yield radius of curvature of the coiled tubing. In another embodiment, the angles of the first and second reversible knuckle joints are adjusted in response to loads applied to the apparatus.

Yet another exemplary embodiment of the present invention provides a bottom hole assembly for lateral tunneling in a wellbore, the bottom hole assembly comprising: coiled tubing connected to the bottom hole assembly; a nozzle connected adjacent a lower end of the bottom hole assembly, the nozzle being in fluid communication with the coiled tubing; a first reversible knuckle joint, the first reversible knuckle joint having a bore and being connected to the bottom hole assembly below the coiled tubing; and a second reversible knuckle joint, the second reversible knuckle joint having a bore and being connected to the bottom hole assembly below the first reversible knuckle joint; wherein the first and second reversible knuckle joints allow the bottom hole assembly to bend in a first direction and to bend in a second direction opposite the first direction. In another embodiment, the first and second reversible knuckle joints are pressure operated.

In yet another exemplary embodiment, the bottom hole assembly further comprises a wand having a central bore, a first end, and a second end, wherein the first end of the wand is connected below the second reversible knuckle joint and the nozzle is connected to the second end of the wand. In another embodiment, the wand comprises a telescoping section. In yet another exemplary embodiment, the first reversible knuckle joint and the second reversible knuckle joint are adapted to bend in substantially the same plane. In another embodiment, the nozzle comprises a plurality of ports in an asymmetrical pattern. In another embodiment, the asymmetrical pattern is adapted to form an elliptical hole in a wellbore formation. In yet another exemplary embodiment, the nozzle comprises a plurality of ports in a symmetrical pattern and a plurality of flow channels in an asymmetrical pattern. In another embodiment, the angles of the first and second reversible knuckle joints are adjusted in response to loads applied to the bottom hole assembly.

An exemplary method of the present invention provides a method of creating a lateral tunnel within a wellbore, the method comprising the steps of: connecting a bottom hole assembly to coiled tubing, the bottom hole assembly comprises an upper reversible knuckle joint, a lower reversible knuckle joint, and a nozzle located below the lower reversible knuckle joint; positioning the bottom hole assembly at a desired location within the wellbore; actuating at least one of the upper or lower reversible knuckle joints, wherein the nozzle moves towards the wellbore; initiating a lateral tunnel substantially transverse to the wellbore, thereby creating a lateral window; adjusting an angle of at least one of the upper or lower reversible knuckle joints such that the bottom hole assembly is allowed to move into the lateral window; and creating the lateral tunnel. The method may further comprise the step of extending the nozzle towards the lateral tunnel. Yet another exemplary method comprises the step of orienting the upper reversible knuckle joint and the lower reversible knuckle joint such that the knuckle joints bend on substantially the same plane.

Yet another exemplary method comprises the step of moving the coiled tubing downhole to create a longer lateral tunnel, the angle of at least one of the upper or lower reversible knuckle joints being adjusted as the bottom hole assembly moves through the lateral tunnel. Another method may comprise the steps of locating the nozzle at a different location in the wellbore, and pumping acid down the coiled tubing and jetting acid out of the nozzle, wherein the acid creates a second acid tunnel substantially transverse to the wellbore. In yet another method, the step of creating the lateral tunnel comprises jetting fluid out of a nozzle of the bottom hole assembly in a symmetrical pattern while allowing the fluid to flow back past the nozzle in an asymmetrical pattern. Another exemplary method comprises the step of pumping acid to enlarge at least one of the wellbore or lateral tunnel diameters such that the bottom hole assembly is allowed to move through the lateral tunnel more efficiently. In yet another method, the acid is pumped while the bottom hole assembly angled in a stationary position.

Yet another exemplary method of the present invention provides a method of creating a lateral tunnel within a wellbore, the method comprising the steps of: connecting a bottom hole assembly to coiled tubing, the bottom hole assembly being adapted to create a lateral tunnel substantially transverse to the wellbore; positioning the bottom hole assembly at a desired location within the wellbore; actuating the bottom hole assembly such that the bottom hole assembly bends to a first angle towards the wellbore; initiating the lateral tunnel, thereby creating a lateral window; adjusting the bottom hole assembly such that the bottom hole assembly bends to a second angle, thereby allowing the bottom hole assembly to move into the lateral window; and creating the lateral tunnel. Yet another method comprises the step of adjusting the second angle of the bottom hole assembly as the bottom hole assembly moves through the lateral tunnel. Yet another method comprises the step of adjusting the first or second angle in response to loads applied to the bottom hole assembly. Yet another exemplary method comprises the step of reversing at least one of the bending motions. Yet another exemplary method comprises the step of creating an elliptical lateral tunnel. Moreover, another exemplary embodiment, comprises the step of pumping fluid to enlarge at least one of the wellbore or lateral tunnel diameters.

Although various embodiments have been shown and described, the invention is not so limited and will be understood to include all such modifications and variations as would be apparent to one skilled in the art. Accordingly, the invention is not to be restricted except in light of the attached claims and their equivalents.

What is claimed is:

1. An apparatus for lateral tunneling within a wellbore, the apparatus comprising:

a tool assembly having an upper end and a lower end, the tool assembly having an internal fluid passage;

coiled tubing connected to the upper end of the tool assembly, the coiled tubing is in fluid communication with the internal passage of the tool assembly, the tool assembly comprising:

a first reversible knuckle joint connected to the tool assembly, the first reversible knuckle joint having a central bore in fluid communication with the internal passage of the tool assembly;

a second reversible knuckle joint, the second reversible knuckle joint having a central bore in communication with the central bore of the first reversible knuckle joint, the second reversible knuckle joint being connected below the first reversible knuckle joint;

a wand having a first end, a second end, and a central bore, the first end of the wand being connected below the second reversible knuckle joint, wherein the central bore of the wand is in fluid communication with the central bore of the second reversible knuckle joint; and a nozzle connected to the second end of the wand, wherein the nozzle is in fluid communication with the coiled tubing, wherein the first and second reversible knuckle joints are adapted so that down hole loads can overcome an activating drive device of the first and second reversible knuckle joints in a manner that allows the first and second reversible knuckle joints to adjust angles during tunneling and the tool assembly includes only two reversible knuckle joints.

2. An apparatus as defined in claim 1, wherein the wand is telescopic.

3. An apparatus as defined in claim 1, wherein the first reversible knuckle joint and the second reversible knuckle joint are adapted to bend in the same plane.

4. An apparatus as defined in claim 3, wherein a radius of curvature of the apparatus is more than a yield radius of curvature of the coiled tubing.

5. An apparatus as defined in claim 1, wherein the tool assembly includes a limit to an angle of the second reversible knuckle joint configured to set a maximum dogleg angle for the wellbore derived as a function of a wellbore diameter, a tool assembly diameter, and a maximum length of straight tool above the nozzle, the maximum dogleg angle being sufficient to allow the maximum length of straight tool to turn a corner into a lateral tunnel formed with the bottom hole assembly.

6. An apparatus as defined in claim 1, wherein the second reversible knuckle joint is configured to activate preferentially to the first reversible knuckle joint.

7. An apparatus as defined in claim 1, further comprising a member separating the second reversible knuckle joint from the first reversible knuckle joint, the member having a length, and wherein the first reversible knuckle joint and the second reversible knuckle joint are consecutive knuckle joints.

8. A bottom hole assembly for lateral tunneling in a wellbore, the bottom hole assembly being connected to a coiled tubing, the bottom hole assembly comprising:

a nozzle connected adjacent a lower end of the bottom hole assembly, the nozzle being in fluid communication with the coiled tubing;

a first reversible knuckle joint, the first reversible knuckle joint having a bore and being connected to the bottom hole assembly below the coiled tubing;

a second reversible knuckle joint, the second reversible knuckle joint having a bore and being connected to the bottom hole assembly below the first reversible knuckle joint; and wherein the first and second reversible knuckle joints are adapted so that down hole loads can overcome an activating drive device of the first and second reversible knuckle joints in a manner that allows the first and second reversible knuckle joints to allow the bottom hole assembly to bend in a first direction and to bend in a second direction opposite the first direction as the bottom hole assembly navigates through a lateral tunnel in the wellbore and are adapted so that the second reversible knuckle joint activates preferentially to the first reversible knuckle joint.

9. A bottom hole assembly as defined in claim 8, wherein the first and second reversible knuckle joints are pressure operated.

10. A bottom hole assembly as defined in claim 8, the bottom hole assembly further comprising a wand having a central bore, a first end, and a second end, wherein the first end of the wand is connected below the second reversible knuckle joint and the nozzle is connected to the second end of the wand.

11. A bottom hole assembly as defined in claim 10, wherein the wand comprises a telescoping section.

12. A bottom hole assembly as defined in claim 8, wherein the first reversible knuckle joint and the second reversible knuckle joint are adapted to bend in substantially the same plane.

13. A bottom hole assembly as defined in claim 8, wherein the nozzle comprises a plurality of ports in an asymmetrical pattern.

14. A bottom hole assembly as defined in claim 13, wherein the asymmetrical pattern is adapted to form an elliptical hole in a wellbore formation.

15. A bottom hole assembly as defined in claim 8, wherein the nozzle comprises a plurality of ports in a symmetrical pattern and a plurality of flow channels in an asymmetrical pattern.

16. A bottom hole assembly as defined in claim 8, wherein the bottom hole assembly includes a limit to an angle of the lower reversible knuckle joint configured to set a maximum dogleg angle for the wellbore derived as a function of a wellbore diameter, a bottom hole assembly diameter, and a maximum length of straight tool above the nozzle, the maximum dogleg angle being sufficient to allow the maximum length of straight tool to turn a corner into a lateral tunnel formed with the bottom hole assembly.

17. A bottom hole assembly as defined in claim 8, further comprising a member separating the second reversible knuckle joint from the first reversible knuckle joint, the member having a length, and wherein the first reversible knuckle joint and the second reversible knuckle joint are consecutive knuckle joints.

18. A method of creating a lateral tunnel within a wellbore, the method comprising the steps of:

(a) connecting a bottom hole assembly to coiled tubing, the bottom hole assembly comprising an upper reversible knuckle joint, a lower reversible knuckle joint, and a nozzle located below the lower reversible knuckle joint, a member separating the lower reversible knuckle joint from the upper reversible knuckle joint, the member having a length, and wherein the upper reversible knuckle joint and the lower reversible knuckle joint are consecutive knuckle joints;

(b) positioning the bottom hole assembly at a desired location within the wellbore;

(c) actuating at least one of the upper or lower reversible knuckle joints, wherein the nozzle moves towards the wellbore, the bottom hole assembly including a limit to an angle of the lower reversible knuckle joint configured to set a maximum dogleg angle for the wellbore derived as a function of a wellbore diameter, a bottom hole assembly diameter, and a maximum length of straight tool above the nozzle, the maximum dogleg angle being sufficient to allow the maximum length of straight tool to turn a corner into a lateral tunnel formed with the bottom hole assembly;

(d) initiating a lateral window;

(e) adjusting an angle of at least one of the upper or lower reversible knuckle joints such that the bottom hole assembly is allowed to move into the lateral window; and (f) creating the lateral tunnel substantially transverse to the wellbore.

19. A method as defined in claim 18, the method further comprising the step of extending the nozzle towards the lateral tunnel.

20. A method as defined in claim 18, the method further comprising the step of orienting the upper reversible knuckle joint and the lower reversible knuckle joint such that the knuckle joints bend on substantially the same plane.

21. A method as defined in claim 18, the method further comprising the step of moving the coiled tubing downhole to create a longer lateral tunnel, the angle of at least one of the upper or lower reversible knuckle joints being adjusted as the bottom hole assembly moves through the lateral tunnel.

22. A method as defined in claim 18, the method further comprising the steps of locating the nozzle at a different location in the wellbore, and pumping acid down the coiled tubing and jetting acid out of the nozzle, wherein the acid creates a second acid tunnel substantially transverse to the wellbore.

23. A method as defined in claim 18, wherein step (f) comprises jetting fluid out of a nozzle of the bottom hole assembly in a symmetrical pattern while allowing the fluid to flow back past the nozzle in an asymmetrical pattern.

24. A method as defined in claim 18, the method further comprising the step of pumping acid to enlarge at least one of the wellbore or lateral tunnel diameters such that the bottom hole assembly is allowed to move through the lateral tunnel more efficiently.

25. A method as defined in claim 24, wherein acid is pumped while the bottom hole assembly is angled in a stationary position.

26. A method as defined in claim 18, wherein the lower reversible knuckle joint activates preferentially to the upper reversible knuckle joint.

27. A method as defined in claim 18, further comprising a member separating the lower reversible knuckle joint from the upper reversible knuckle joint, the member having a length, and wherein the upper reversible knuckle joint and the lower reversible knuckle joint are consecutive knuckle joints.

* * * * *